US010578367B2

(12) United States Patent
Pearson et al.

(10) Patent No.: US 10,578,367 B2
(45) Date of Patent: Mar. 3, 2020

(54) PLATE HEAT EXCHANGER WITH ALTERNATING SYMMETRICAL AND ASYMMETRICAL PLATES

(71) Applicant: Carrier Corporation, Jupiter, FL (US)

(72) Inventors: Matthew Robert Pearson, Hartford, CT (US); Abbas A. Alahyari, Manchester, CT (US); John H. Whiton, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/824,414

(22) Filed: Nov. 28, 2017

(65) Prior Publication Data

US 2018/0149434 A1 May 31, 2018

Related U.S. Application Data

(60) Provisional application No. 62/426,714, filed on Nov. 28, 2016.

(51) Int. Cl.

| | |
|---|---|
| ***F28D 9/00*** | (2006.01) |
| ***F28F 3/08*** | (2006.01) |
| ***F28F 3/04*** | (2006.01) |

(52) U.S. Cl.

CPC ..... *F28D 9/0093* (2013.01); *F28D 9/005* (2013.01); *F28F 3/046* (2013.01); *F28F 3/08* (2013.01)

(58) Field of Classification Search

CPC ..... F28D 9/0093; F28D 9/005; F28D 9/0031; F28D 9/0037; F28D 9/0081; F28D 1/0308; F28F 3/046; F28F 3/08

See application file for complete search history.

(56) References Cited

U.S. PATENT DOCUMENTS

| | | | | |
|---|---|---|---|---|
| 3,371,709 | A | 3/1968 | Rosenblad | |
| 4,293,033 | A * | 10/1981 | Nasser | F28D 9/0031 165/166 |
| 4,346,760 | A | 8/1982 | Vidal-Meza | |
| 4,396,058 | A | 8/1983 | Kurschner et al. | |
| 4,781,248 | A | 11/1988 | Pfeiffer | |
| 5,111,876 | A * | 5/1992 | Nash | F28F 1/325 165/110 |
| 5,806,584 | A | 9/1998 | Thonon et al. | |
| 6,019,160 | A | 2/2000 | Chen | |
| 6,109,254 | A * | 8/2000 | Reinke | F24H 3/105 126/110 R |
| 9,389,028 | B2 | 7/2016 | Dahlberg | |
| 9,448,015 | B2 | 9/2016 | Seebald | |

(Continued)

FOREIGN PATENT DOCUMENTS

| | | |
|---|---|---|
| CN | 2119632 U | 10/1992 |
| GB | 992413 A | 5/1965 |

*Primary Examiner* — Travis C Ruby
(74) *Attorney, Agent, or Firm* — Cantor Colburn LLP

(57) ABSTRACT

A plate heat exchanger includes a plurality of main plates stacked to define a first cavity to direct a first fluid therethrough and a second cavity to direct a second fluid therethrough, the second fluid different from and kept separated from the first fluid. Each main plate has one or more peaks and one or more valleys formed therein. A ratio of wavelength between adjacent peaks or between adjacent valleys of the main plate to an amplitude between a peak and an adjacent valley of the main plate is equal to or greater than 7.0.

8 Claims, 4 Drawing Sheets

(56) References Cited

U.S. PATENT DOCUMENTS

| | | | | |
|---|---|---|---|---|
| 2006/0289152 | A1* | 12/2006 | Leuschner | F28D 9/0062 165/152 |
| 2008/0264616 | A1 | 10/2008 | Deschodt et al. | |
| 2010/0218927 | A1 | 9/2010 | Cooper et al. | |
| 2010/0282437 | A1 | 11/2010 | Birmingham et al. | |
| 2011/0127022 | A1 | 6/2011 | Eller et al. | |
| 2012/0305217 | A1 | 12/2012 | Cowburn et al. | |
| 2014/0290921 | A1* | 10/2014 | Ito | F28F 3/046 165/166 |
| 2015/0041110 | A1* | 2/2015 | Ito | F28F 3/046 165/166 |

* cited by examiner

PLATE HEAT EXCHANGER WITH ALTERNATING SYMMETRICAL AND ASYMMETRICAL PLATES

CROSS-REFERENCE TO RELATED APPLICATIONS

This application claims the benefit of 62/426,714, filed Nov. 28, 2016, which is incorporated herein by reference in its entirety.

BACKGROUND

Embodiments of this disclosure relate generally to heat exchangers. More specifically, the present disclosure relates to plate heat exchangers.

Plate Heat Exchangers (PHEs) and Brazed Plate Heat Exchangers (BPHEs) are formed of a series of plates that are stacked and sealed/brazed to form separate flow paths for two fluids. In many such PHEs and BPHEs, the fluids are typically refrigerant circulated through a first flow path and water or brine circulated through a second flow path, with the PHE or BPHE facilitating thermal energy exchange between the two fluids. PHEs and BPHEs are utilized in, for example, commercial or residential chillers.

SUMMARY

In one embodiment, a plate heat exchanger includes a plurality of main plates stacked to define a first cavity to direct a first fluid therethrough and a second cavity to direct a second fluid therethrough, the second fluid different from and kept separated from the first fluid. Each main plate has one or more peaks and one or more valleys formed therein. A ratio of wavelength between adjacent peaks or between adjacent valleys of the main plate to an amplitude between a peak and an adjacent valley of the main plate is equal to or greater than 7.0.

Additionally or alternatively, in this or other embodiments the ratio is between 10 and 25.

Additionally or alternatively, in this or other embodiments the plurality of main plates includes one or more symmetric plates.

Additionally or alternatively, in this or other embodiments the one or more symmetric plates have a cross-sectional shape defined by a cosine wave.

Additionally or alternatively, in this or other embodiments the plurality of main plates includes one or more asymmetric plates.

Additionally or alternatively, in this or other embodiments the one or more asymmetric plates have a cross-sectional shape defined by a two-term Fourier cosine series.

Additionally or alternatively, in this or other embodiments the wavelength of the asymmetric plate is 18 millimeters or more.

Additionally or alternatively, in this or other embodiments the asymmetric plate includes a first amplitude of a first cosine mode greater than a second amplitude of a second cosine mode.

Additionally or alternatively, in this or other embodiments the first amplitude of the first cosine mode is 1.1 millimeters or less.

Additionally or alternatively, in this or other embodiments the second amplitude of the second cosine mode is 0.6 millimeters or less.

Additionally or alternatively, in this or other embodiments one or more symmetric plates are alternatingly stacked with the one or more asymmetric plates.

Additionally or alternatively, in this or other embodiments the main plates have a chevron angle of 35 degrees or greater.

In another embodiment, a plate for a plate heat exchanger at least partially defines a first cavity to direct a first fluid therethrough and a second cavity to direct a second fluid therethrough, the second fluid different from and kept separate from the first fluid. The plate has one or more peaks and one or more valleys formed therein. A ratio of wavelength between adjacent peaks or between adjacent valleys of the main plate to an amplitude between a peak and an adjacent valley of the main plate is equal to or greater than 7.0.

Additionally or alternatively, in this or other embodiments the ratio is between 10 and 25.

Additionally or alternatively, in this or other embodiments the plate has a cross-sectional shape defined by a cosine wave.

Additionally or alternatively, in this or other embodiments the plate has a cross-sectional shape defined by a two-term Fourier cosine series.

Additionally or alternatively, in this or other embodiments the wavelength of the plate is 18 millimeters or more.

Additionally or alternatively, in this or other embodiments the amplitude is 1.1 millimeters or less.

Additionally or alternatively, in this or other embodiments the amplitude is 0.6 millimeters or less.

Additionally or alternatively, in this or other embodiments the plate has a chevron angle of 35 degrees or greater.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Symmetric PHEs or BPHEs are constructed such that the first flow path and the second flow path have equal flow areas for the two fluids. The symmetric construction, however, can lead to a mass flux of one or both fluids through the heat exchanger which is not optimal. For example, a mass flux of the refrigerant through the first flow path may be lower than desired, while additionally or alternatively, a mass flux of the water or brine through the second flow path may be greater than desired. As a result, refrigerant-side heat transfer underperforms, and liquid-side pressure drop can be too high, thus limiting capacity of a heat exchanger of a given size. In an attempt to correct the mass flow differences, some PHEs and BPHEs are constructed asymmetrically, with different flow areas for the two fluids. Asymmetric PHEs and BPHEs have limitations as well, however.

Figure 1:
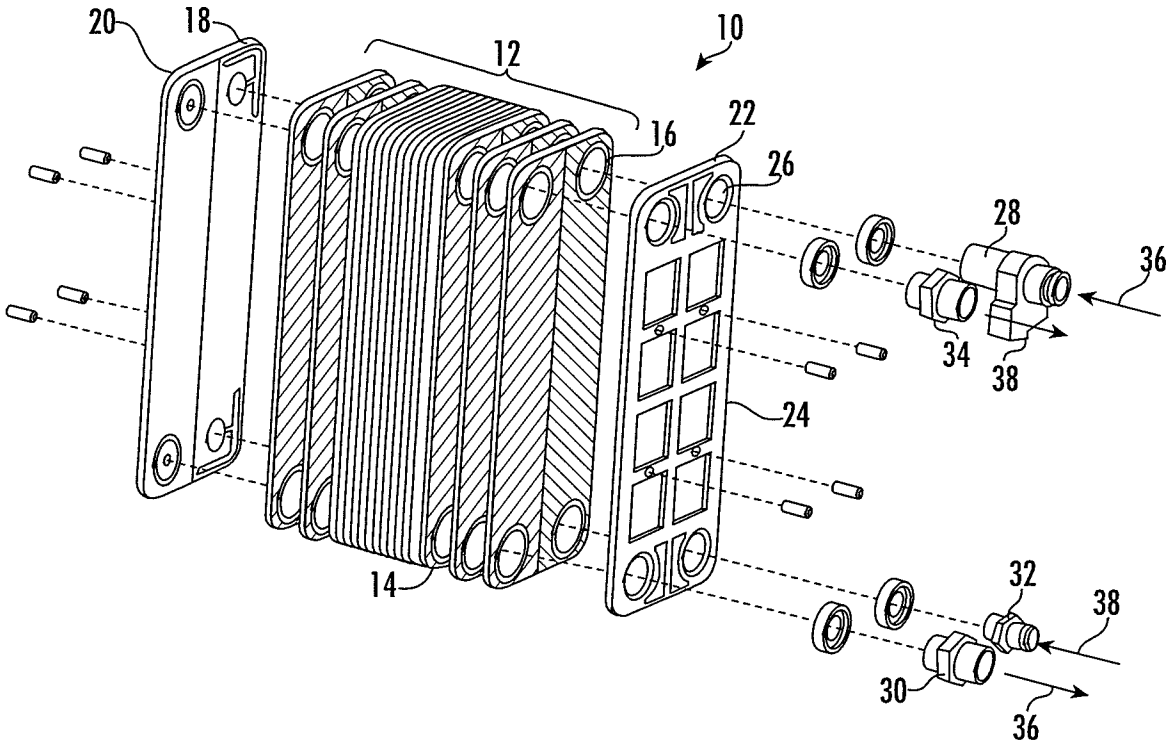
FIG. 1 is a partially exploded view of an embodiment of a plate heat exchanger.

Referring now to FIG. 1, illustrated is a partially exploded view of a plate heat exchanger 10. The plate heat exchanger 10 includes main plates 12, having ridged regions 14 and openings 16 corresponding to inlets and outlets of a fluid. The ridged regions 14 of the main plates 12 may have a herringbone, chevron or other suitable pattern to increase a surface area of the main plate 12 contacted by the fluid and to generate turbulence in the fluid. Adjacent main plates 12 are typically joined by, for example, brazing to define cavities between adjacent main plates 12 for fluid flow therethrough. The openings 16 of the main plates 12 may be provided, alternatingly, with protrusions or recesses surrounding the openings 16 to alternate a fluid that enters the cavities defined between adjacent main plates 12. For example a first fluid may enter first, third and fifth cavities between main plates 12, and a second fluid may enter second, fourth and sixth cavities between main plates 12. The fluids are maintained separate and exchange thermal energy as the fluids flow through the cavities.

The plate heat exchanger 10 includes a first end plate 18 at a first end 20 of the plate heat exchanger 10 and a second end plate 22 located at a second end 24 of the plate heat exchanger 10, opposite the first end 20. The first end plate 18 and/or the second end plate 22 includes end plate openings 26 which can be substantially aligned with the openings 16 in the main plates to receive fluid fittings 28, 30, 32, 34 for entry of first fluid 36 and second fluid 38 into the plate heat exchanger 10, and for exit of first fluid 36 and second fluid 38 from the plate heat exchanger 10. For example, first fluid 36 may be input into the heat exchanger 10 via fitting 28 and output from the heat exchanger 10 via fitting 30, and second fluid 38 may be input into the heat exchanger 10 via fitting 32 and output from the heat exchanger 10 via fitting 34. While main plates 12 are shown having a rectangular shape in FIG. 1, it is to be appreciated that main plates 12 having other shapes may be utilized. For example, main plates 12 may have other rectangular, square, oval or any polygonal shape. Further, openings 16 and 26 may have a circular shape, oval shape, square shape, or any other desired cross-sectional shape. Embodiments are not limited to those illustrated, but include heat exchangers 10 having any desired shape.

Figure 2:
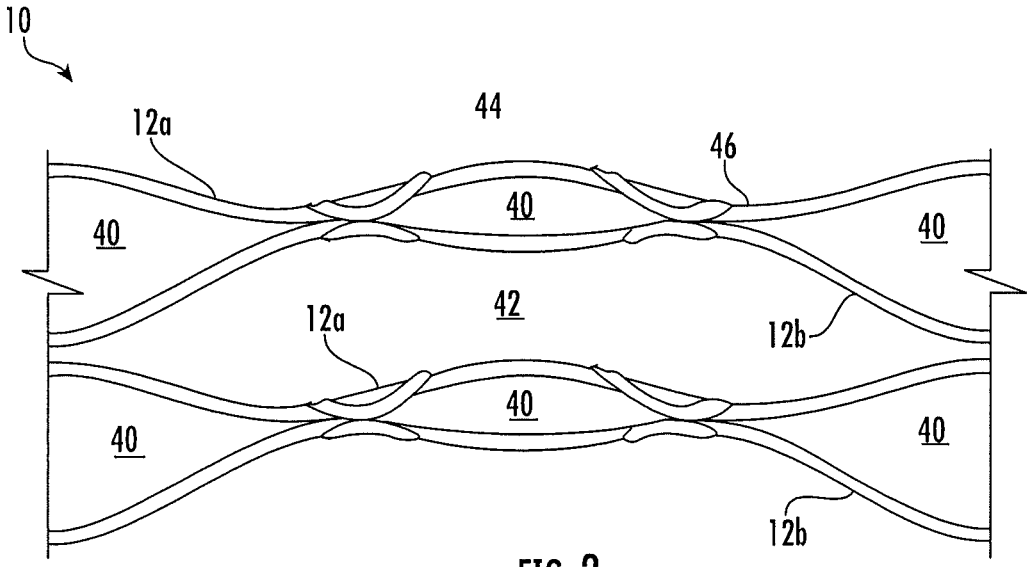
FIG. 2 is a schematic, cross-sectional view of a plate arrangement in an embodiment of a plate heat exchanger.

Referring now to FIG. 2, a cross-sectional view of heat exchanger 10 is illustrated. The main plates 12 are stacked to form the heat exchanger 10. The main plates 12 are layered such that first cavities 40 carry first fluid 36 and second cavities 42 carry second fluid 38. In some embodiments, the first fluid 36 is a refrigerant, and the second fluid 38 is water or a brine solution. The first cavity 40 and the second cavity 42 are defined between adjacent main plates, which as shown in FIG. 2, may have a plurality of peaks 44 and valleys 46. In some embodiments, a peak 44 of a first main plate 12 may contact or be secured to a valley 46 of an adjacent main plate 12. Adjacent main plates 12 can be secured by, for example, brazing, welding, adhesive bonding, the use of tie rods or other mechanical fasteners, or the like. The main plates 12 may be defined as curvilinear between peaks 44 and valleys 46, or alternatively may be substantially linear between adjacent peaks 44 and valleys 46.

The main plates 12 each have a wavelength λ between adjacent peaks 44 or between adjacent valleys 46. Further, the main plates 12 each have an amplitude A between a peak 44 and an adjacent valley 46. Wavelength λ and amplitude A together define an aspect ratio λ/A equal to or greater than 7.0. In some embodiments, the aspect ratio λ/A is between 10 and 25.

In some embodiments, the plurality of main plates 12 includes one or more symmetric plates 12*a*. The symmetric plates can be cross-sectionally shaped as cosine waves, as shown, other curvilinear forms, or may extend linearly between peaks 44 and valleys 46. In some embodiments, the wavelength λ of the symmetric plates 12*a* is 9 mm or greater. An aspect ratio λ/A of symmetric plates 12*a* is equal to or greater than 7.0. In some embodiments, the aspect ratio λ/A is between 10 and 25.

Figure 3:
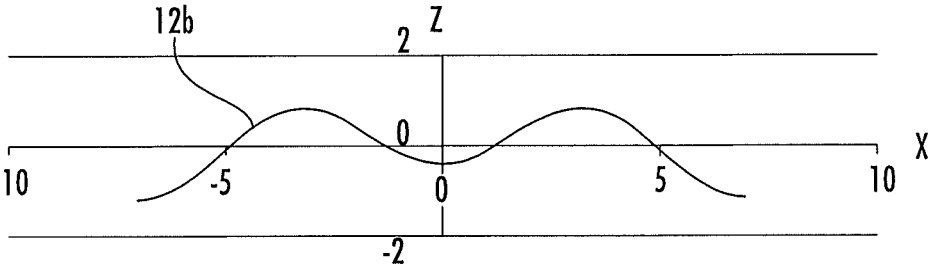
FIG. 3 is a schematic view of an embodiment of an asymmetric plate for a plate heat exchanger.

Additionally or alternatively, the plurality of main plates 12 can include one or more asymmetric plates 12*b*, an example of which is shown in FIG. 3. The asymmetric plates 12*b* can have a curvilinear cross-sectional shape between adjacent peaks 44 and valleys 46, or alternatively can extend linearly between adjacent peaks 44 and valleys 46, and are asymmetric about an X-axis. Asymmetric plates can be defined by a two-term Fourier cosine series as in equation 1 below.

$$z=A_1\cos(2\pi x'/\lambda)-A_2\cos(4\pi x/\lambda) \qquad \text{Equation 1:}$$

where $A_1$ is a first cosine mode zero-to-peak amplitude, $A_2$ is a second cosine mode zero-to-peak amplitude, λ is the wavelength. The resulting z is a "Z" position along the curve relative to a Z-axis at a given location x' along the X-axis.

In some embodiments, the wavelength λ of the asymmetric plates 12*b* is 18 mm or greater. In some embodiments the first cosine mode amplitude $A_1$ is 1.1 mm or less, while in other embodiments the second cosine mode amplitude $A_2$ is 0.6 mm or less. The difference in highest and lowest points in this path is defined as a peak-to-peak amplitude A. The ratio λ/A is greater than or equal to 7. In some embodiments, the aspect ratio λ/A is between 10 and 25.

Figure 4:
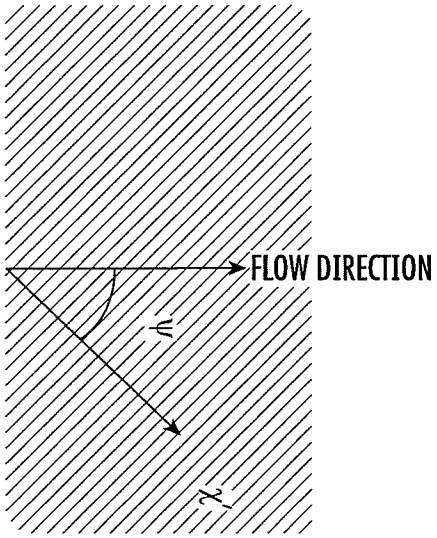
FIG. 4 is a schematic view of an embodiment of an asymmetric plate for a heat exchanger illustrating a chevron angle.

Referring now to FIG. 4, the symmetric plate 12*a* and asymmetric plate 12*b* have a chevron angle ψ relative to the X-axis of 35 degrees or greater.

Some embodiments of heat exchanger 10 include only symmetric plates 12*a*. In some embodiments, the symmetric plates 12*a* have the same cross-sectional shape or geometric configuration, while in other embodiments the symmetric plates 12*a* may differ.

Further, as shown in FIG. 2, symmetric plates 12*a* and asymmetric plates 12*b* may be utilized in combination in the heat exchanger 10, with symmetric plates 12*a* stacked alternatingly with the asymmetric plates 12*b*. Cross-sectional shape or geometric configuration of either or both of the symmetric plates 12*a* or the asymmetric plates 12*b* may be varied in the heat exchanger 10.

The heat exchanger 10 described herein with symmetric plates 12*a* alternatingly stacked with asymmetric plates 12*b*, having relatively long wavelengths 2\, and relatively small peak-to-peak amplitudes A demonstrates significant reductions of up to 30% material required for a given capacity heat exchanger at the same liquid-side pressure drop. Further, refrigerant charge for a given capacity heat exchanger may be significantly reduced, in some embodiments up to about 50 percent, resulting in significant cost savings. The heat exchanger 10 further provides a 2X capacity increase for a fixed heat exchanger physical envelope. The capacity increase may allow heat exchangers 10 to displace shell-and-tube heat exchangers in some applications.

While the disclosure has been described in detail in connection with only a limited number of embodiments, it should be readily understood that the disclosure is not limited to such disclosed embodiments. Rather, the invention can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A plate heat exchanger comprising a plurality of main plates stacked to define a plurality of first cavities to direct a first fluid therethrough and a plurality of second cavities to direct a second fluid therethrough, the second fluid different from and kept separated from the first fluid, each main plate having one or more peaks and one or more valleys formed therein;

wherein a ratio of wavelength between adjacent peaks or between adjacent valleys of the main plate to an amplitude between a peak and an adjacent valley of the main plate is equal to or greater than 7.0;

wherein the plurality of main plates include a plurality of symmetric plates each defined by a first wave shape extending along an x-axis, alternatingly stacked with a plurality of asymmetric plates, each of the asymmetric plates defined by a second wave shape extending along the x-axis, the asymmetric plates asymmetric about the x-axis, the plurality of symmetric plates and the plurality of asymmetric plates defining the plurality of first cavities and the plurality of second cavities therebetween, a symmetric plate of the plurality of symmetric plates and an asymmetric plate of the plurality of asymmetric plates together define a heat exchanger layer; and wherein laterally adjacent first cavities along the x-axis of the same heat exchanger layer have unequal cross-sectional areas;

wherein the one or more symmetric plates have a cross-sectional shape defined by a cosine wave; and wherein the one or more asymmetric plates have a cross-sectional shape defined by a cosine series having a variable amplitude.

2. The plate heat exchanger of claim 1, wherein the ratio is between 10 and 25.

3. The plate heat exchanger of claim 1, wherein the wavelength of the asymmetric plate is 18 millimeters or more.

4. The plate heat exchanger of claim 1, wherein the asymmetric plate includes a first amplitude of a first cosine mode greater than a second amplitude of a second cosine mode.

5. The plate heat exchanger of claim 4, wherein the first amplitude of the first cosine mode is 1.1 millimeters or less.

6. The plate heat exchanger of claim 4, wherein the second amplitude of the second cosine mode is 0.6 millimeters or less.

7. The plate heat exchanger of claim 1, including one or more symmetric plates alternatingly stacked with the one or more asymmetric plates.

8. The plate heat exchanger of claim 1, wherein the main plates have a chevron angle of 35 degrees or greater between a first portion of a peak of the plurality of peaks and a second portion of a peak of the plurality of peaks abutting the first portion.

* * * * *